United States Patent [19]

Passamoni

[11] Patent Number: 4,828,164

[45] Date of Patent: May 9, 1989

[54] FOLDED CARTON HAVING INTEGRAL HEADER

[76] Inventor: Phillip L. Passamoni, 706 St. Joseph St., Green Bay, Wis. 54301

[21] Appl. No.: 94,754

[22] Filed: Sep. 4, 1987

[51] Int. Cl.[4] ..... B54D 5/36

[52] U.S. Cl. ..... 229/41 R; 206/44 R; 206/459; 229/41 B

[58] Field of Search ..... 206/44 R, 459; 229/41 R, 41 B, 16 D; 40/308, 312

[56] References Cited

U.S. PATENT DOCUMENTS

| | | | |
|---|---|---|---|
| 1,765,484 | 6/1930 | Gray | 40/312 |
| 2,284,283 | 5/1942 | Himes | 229/41 B |
| 3,089,631 | 5/1963 | Tyrseck et al. | 229/41 R |
| 3,195,797 | 7/1965 | Feo | 206/41 B |
| 3,571,960 | 3/1971 | Karel | 40/312 |
| 3,861,581 | 1/1975 | Sellors | 229/41 R |
| 4,396,115 | 8/1983 | Watson | 206/44 R |

FOREIGN PATENT DOCUMENTS

| | | | |
|---|---|---|---|
| 1346801 | 2/1974 | United Kingdom | 206/44 R |

*Primary Examiner*—Stephen Marcus
*Assistant Examiner*—Gary E. Elkins

[57] ABSTRACT

A folded container formed from a single sheet of material and having an integral header. In the flat unfolded state, the sheet comprises a series of generally rectangular side wall panels connected together by fold lines and the side wall panels have aligned side edges. A series of bottom wall panels each has an inner edge connected by a fold line to a side edge of the corresponding side wall panel. A connecting panel is connected to the outer edge of an end bottom wall panel of the series by a severable joint, and a header panel is connected by a fold line to the outer edge of the connecting panel. In the folded, unopened state, the end bottom wall panel is disposed flatwise against the corresponding end side wall panel and the connecting panel is glued flat against the end side wall panel, with the header panel projecting upwardly beyond the side wall panel. The container is moved to its open state by skewing the side wall panels to a rectangular configuration, thus severing the joint.

7 Claims, 1 Drawing Sheet

FOLDED CARTON HAVING INTEGRAL HEADER

BACKGROUND OF THE INVENTION

Open top cartons or containers are used at the point of purchase to hold and display small articles, such as cosmetic articles, candy, and the like. The cartons are generally rectangular in shape and frequently include upstanding rear headers which bear advertising or other printed material.

From a production standpoint, it is desirable to produce the carton from a single sheet of paperboard, or other material, in a series of folding and gluing operations.

As the outer surfaces of the side walls of the carton, as well as the forwardly facing surface of the header, are normally intended to bear printed material, these surfaces can be coated with clay to provide a smooth printable surface. The coating is applied to one surface of the flat sheet and it is desirable that the carton be constructed so that when the carton is folded, the outer surfaces of the side walls, as well as the forwardly facing surface of the header, have the smooth printable coating.

SUMMARY OF THE INVENTION

The invention is directed to a folded carton or container formed from a single sheet of material and having an integral header.

In the flat unfolded state, the sheet is composed of a series of generally rectangular side wall panels connected together by fold lines and the side wall panels have aligned side edges. A series of bottom wall panels, each has an inner edge connected by a fold line to a side edge of a corresponding side wall panel.

A connecting panel is connected to the outer edge of an end bottom wall panel in the series by a severable joint, and a header panel is connected by a fold line to the outer edge of the connecting panel.

In the folded and unopened state, the end bottom wall panel is folded flat against the corresponding end side wall panel and the connecting panel is glued flatwise against the end side wall panel with the header panel projecting upwardly beyond the upper edge of the end side wall panel.

The folded carton is opened by severing the joint between the connecting panel and the end bottom wall panel and pivoting or skewing the side walls to a rectangular configuration.

In a modified form of the invention, a second header panel can be connected to the opposite side edge of the end side wall panel, and in the glued and folded state, the second header panel will be glued flatwise to the rear surface of the first header panel.

The invention provides a container or carton having an integral upstanding header, which can be folded from a single sheet of paperboard or other material.

One surface of the unfolded sheet can be printed and the container is constructed so that the printed side is on the outer surfaces of the side wall panels, as well as on the forwardly facing surface of the header.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
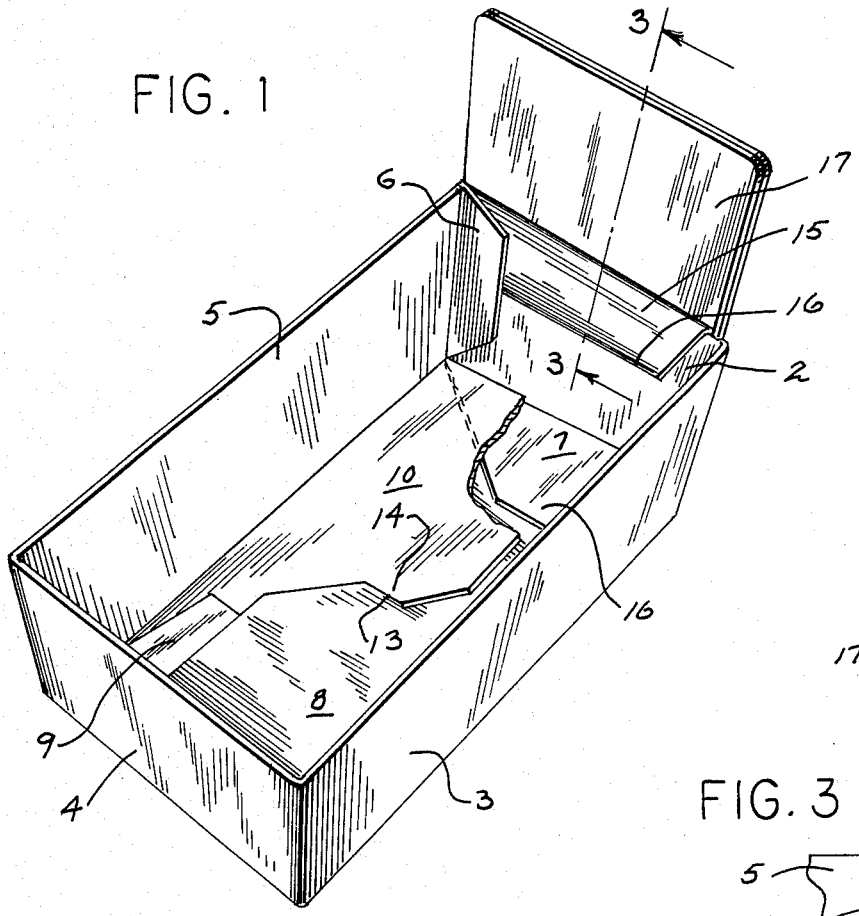
FIG. 1 is a perspective view of the folded carton of the invention in the folded and opened state.
Figure 3:
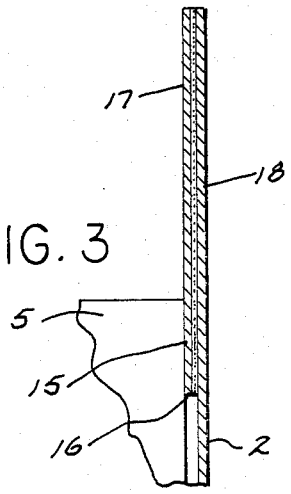
FIG. 3 is an enlarged section taken along line 3—3 of FIG. 1.

FIG. 1 illustrates a folded open top carton or container formed from a single sheet of paperboard, corrugated paperboard, or other material.

Figure 2:
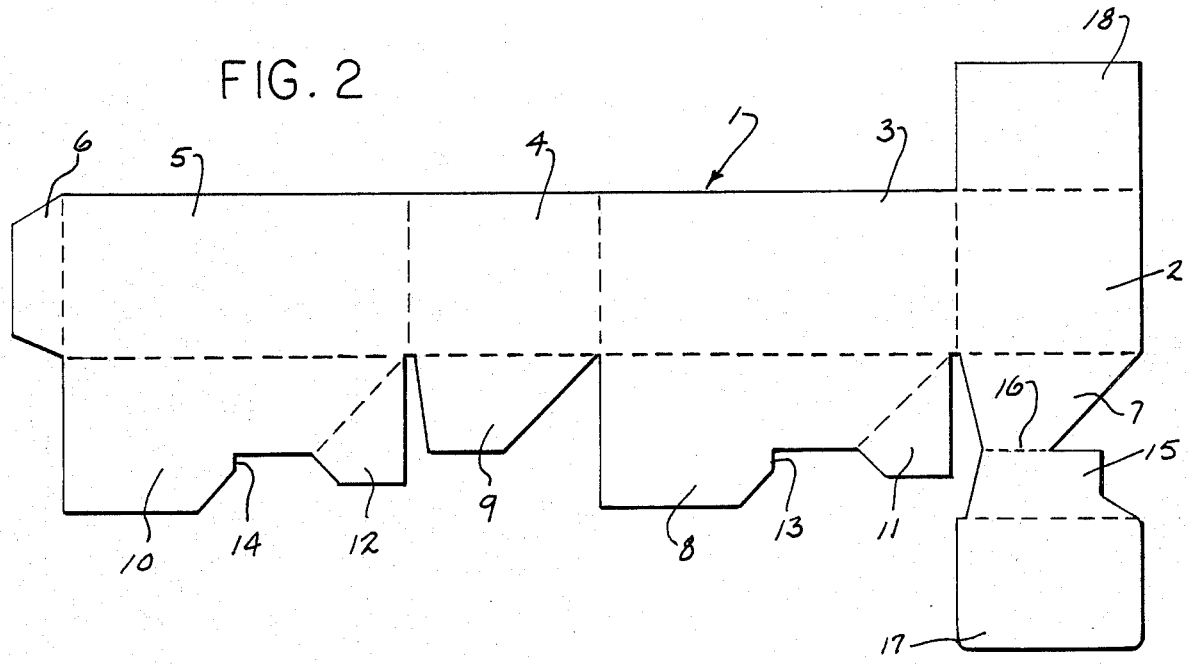
FIG. 2 is a plan view of the carton in the flat unfolded state.

The sheet 1 in its unfolded state is shown in FIG. 2 and includes a series of generally rectangular side wall panels 2, 3, 4 and 5, which are interconnected by fold lines. A connecting panel 6 is connected by a fold line to the outer edge of panel 5. When the sheet is folded to form an open top carton, panels 2 and 4 constitute the ends of the carton, while panels 3 and 5 provide the sides of the carton and connecting panel 6 is glued to panel 2.

A group of bottom wall panels 7, 8 9, and 10 are connected by fold lines to the corresponding side wall panels 2–5. In addition, a connecting flap 11 is connected to bottom wall panel 8 by a fold line or perforation line, and in the folded and glued state, flap 11 is glued to the undersurface of bottom wall panel 7. Similarly, a flap 12 is connected to bottom wall panel 10 by a fold or perforation line and in the folded and glued state of the carton, flap 12 is glued to the undersurface of bottom wall panel 9.

As shown in FIG. 2, bottom wall panels 8 and 10 are provided with notches 13 and 14, respectively, which interlock, as shown in FIG. 1, when the carton is in the folded state.

In accordance with the invention, a connecting panel 15 is connected to the outer edge of bottom wall panel 7 by a severable joint or line 16. Joint 16 is a weakened area formed by perforations, scores, or the like, which is adapted to be severed when the carton is set up in the folded and opened condition, as shown in FIG. 1.

Connected to the outer edge of connecting panel 15 is a header panel 17, which is generally rectangular in configuration. In addition, an optional second header panel 18 can be connected by a fold line to the opposite side edge of side wall panel 2.

The upper surface of the flat sheet 1, as shown in FIG. 2, can be coated with clay, or other material to provide a smooth printable surface. The coated sheet 1 is then run through a printing machine where printing can be applied to the upper surfaces of the side wall panels 2–5, as well as the upper surface of the header panels 17 and 18.

After printing, the sheet is passed through a gluing machine, in which an adhesive layer is applied to the undersurface of flaps 11 and 12, connecting panel 15 and back panel 2.

The sheet is then folded with connecting panel 15 being glued flatwise against the inner surface of side wall panel 2 and the flaps 11 and 12 being glued to the undersurface of the bottom wall panels 7 and 9, respectively. In addition, header panel 18, if incorporated in the sheet, will be glued to the rear surface of header panel 17.

In this state the folded and glued carton will be substantially flat and unopened, with side wall panels 3 and 4 being disposed generally flatwise with respect to side wall panels 2 and 5 and the bottom wall panels projecting upwardly from the lower edges of the side wall panels in the area between the side walls. In this folded, unopened state, the joint 16 will still be attached.

To set up the carton at the time of use, the joint 16 is severed as the side wall panels are moved to a rectangular configuration causing the bottom wall panels to pivot downwardly to a generally flat and horizontal condition The notches 13 and 14 of bottom wall panels 8 and 10 will interlock to hold the carton in the open condition, as shown in FIG. 1.

In the folded and open condition, the outer surfaces of the side wall panels 2–5, as well as the forwardly facing surface of header panel 17 contain the printable coating that can bear printing material. Thus, the invention provides an open top display carton or container formed from a single sheet of material and having an integral rear header. The carton is constructed so that the outer surfaces of the side walls 2–5, as well as the forwardly facing surface of the header 17 are provided with a printable coating.

Various modes of carrying out the invention are contemplated as being within the scope of the following claims particularly pointing out and distinctly claiming the subject matter which is regarded as the invention.

I claim:

1. A folded carton, comprising a sheet of material, said sheet in a flat unfolded state comprising a plurality of side wall panels interconnected by fold lines and disposed to be folded to provide side walls for the folded carton a plurality of bottom wall panels, each bottom wall panel having an inner edge connected by a fold line to a corresponding side wall panel, said bottom wall panels disposed to be folded to provide a bottom for said folded carton, a connecting panel having a pair of opposed edges, one of said opposed edges being connected by a severable joint to the outer edge of a first of said bottom wall panels, a header panel connected to the opposite edge of said connecting panel, in a folded unopened state said first bottom wall panel being disposed flatwise against a first side wall panel and said connecting panel being secured flatwise against said first side wall panel and said header panel projecting upwardly beyond said first side wall panel, in a folded and opened state said joint being severed and said first bottom wall panel being disposed generally horizontally and said side wall panels being in a generally rectangular configuration.

2. The carton of claim 1, and including a smooth pr surface coating on one surface of said sheet, in said folded open state said coating being on the outer surfaces of said side wall panels and on the forwardly facing surface of said header panel.

3. The carton of claim 1, wherein said side wall panels have aligned first side edges and the inner edges of the bottom wall panel are connected to the corresponding side edges.

4. The carton of claim 1, wherein said first side wall panel has a second side edge, and a second header panel connected by a fold line to said second side edge, in said folded state said second header panel being secured flatwise against said first header panel.

5. The carton of claim 4, wherein said first and second header panels have substantially the same size and shape.

6. A folded open to container formed from a single sheet of material, said sheet in the flat unfolded state having a pair of opposed surfaces, a smooth printable coating disposed on one of said surfaces, said sheet comprising a series of generally rectangular side wall panels interconnected by fold lines, a first of said side wall panels being located at the end of said series, said side wall panels having aligned first side edges, a series of bottom wall panels with a first bottom wall panel located at the end of said series, each bottom wall panel having an inner edge connected by a fold line to the first side edges of the corresponding side wall panels and said bottom wall panels each having an outer edge, said first bottom wall panel being connected to said first side wall panel, a connecting panel having an inner edge connected by a severable joint to the outer edge of said first bottom wall panel and having an opposed outer edge, a header panel connected to said outer edge of said connecting panel by a fold line, in folded unopened state said first bottom wall panel being disposed flatwise against said first side wall panel and said connecting panel being secured flatwise against said first side wall panel with said header panel projecting upwardly beyond an upper edge of said first side wall panel, in a folded open state said joint being severed and said first bottom wall panel being disposed generally horizontally and said side wall panels being in a generally rectangular configuration, said coating being disposed on the outer surfaces of said side wall panels and on the forward facing surface of said header panel when said carton is in said folded open state.

7. The carton of claim 6, wherein said first side wall panel has a second side edge and a second header panel connected to said second side edge, in said folded state said second panel being secured flatwise against a rear surface of said first header panel.

* * * * *

UNITED STATES PATENT AND TRADEMARK OFFICE

CERTIFICATE OF CORRECTION

PATENT NO. : 4,828,164

DATED : May 9, 1989

INVENTOR(S) : PHILLIP L. PASSAMONI

It is certified that error appears in the above-identified patent and that said Letters Patent is hereby corrected as shown below:

Cover Page at "[73]" insert ---Assignee: GREEN BAY PACKAGING INC., Green Bay, Wisconsin---; Col. 3, Line 31, After "carton" insert ---,---(comma); Col. 3, Line 49, CLAIM 2, Delete "pr" and substitute therefor ---printable---; Col. 4, Line 5, CLAIM 3 Delete "panel" and substitute therefor ---panels---; Col. 4, line 15, CLAIM 6, Delete "to" and substitute therefor ---top---; Col. 4, Line 16, CLAIM 6, Delete "the" and substitute therefor ---a---; Col. 4, Line 49, CLAIM 7, After "second" insert ---header---.

Cover page before item [57] insert --Attorney, Agent or Firm
Andrus, Sceales, Starke & Sawall--

Signed and Sealed this

Eighth Day of January, 1991

*Attest:*

*Attesting Officer*

HARRY F. MANBECK, JR.

*Commissioner of Patents and Trademarks*